United States Patent [19]

Ochs

[11] Patent Number: 4,875,594

[45] Date of Patent: Oct. 24, 1989

[54] CLOSURE CAP

[75] Inventor: Charles S. Ochs, Lancaster, Ohio

[73] Assignee: Anchor Hocking Corporation, Lancaster, Ohio

[21] Appl. No.: 285,651

[22] Filed: Dec. 16, 1988

[51] Int. Cl.[4] ..... B65D 41/48

[52] U.S. Cl. ..... 215/252; 215/256

[58] Field of Search ..... 215/252, 256

[56] References Cited

U.S. PATENT DOCUMENTS

| | | | |
|---|---|---|---|
| 3,980,195 | 9/1976 | Fillmore | 215/252 |
| 4,576,298 | 3/1986 | Boik | 215/252 |
| 4,694,969 | 9/1987 | Granat | 215/252 |

*Primary Examiner*—Donald F. Norton

*Attorney, Agent, or Firm*—Wood, Herron & Evans

[57] ABSTRACT

A composite closure having a metal shell with metal container engaging lugs and an attached molded plastic tamper evident insert band providing the combination of a pressure resistant seal with a plastic tamper evident indication.

18 Claims, 5 Drawing Sheets

CLOSURE CAP

BACKGROUND OF THE INVENTION

The present invention relates to the sealing art and more particularly to an improved composite closure cap for sealing products employing hot packaging, retorting, or pasteurizing steps during package sealing.

The closure cap is for sealing threaded, lugged or beaded containers and has inwardly projecting metal lugs at the lower edge of a metal shell.

Accordingly, an object of the present invention is to provide an improved composite tamper evident closure cap.

Another object of the present invention is to provide an improved sealed package.

Another object of the present invention is to provide a temper evident closure cap with improved resistance to leakage during processing.

Other and further objects of the invention will be obvious upon an understanding of the illustrative embodiment about to be described or will be indicated in the appended claims, and various advantages not referred to herein will occur to one skilled in the art upon employment of the invention in practice.

BRIEF DESCRIPTION OF THE DRAWINGS

A preferred embodiment of the invention has been chosen for purposes of illustration and description and is shown in the accompanying drawings, forming a part of the specification, wherein.

DESCRIPTION OF THE PREFERRED EMBODIMENT

The closure cap 1 in accordance with the present invention comprises a metal shell with a cover 2 and a depending skirt 3. The cover 2 has a stacking panel 4.

Figure 4:
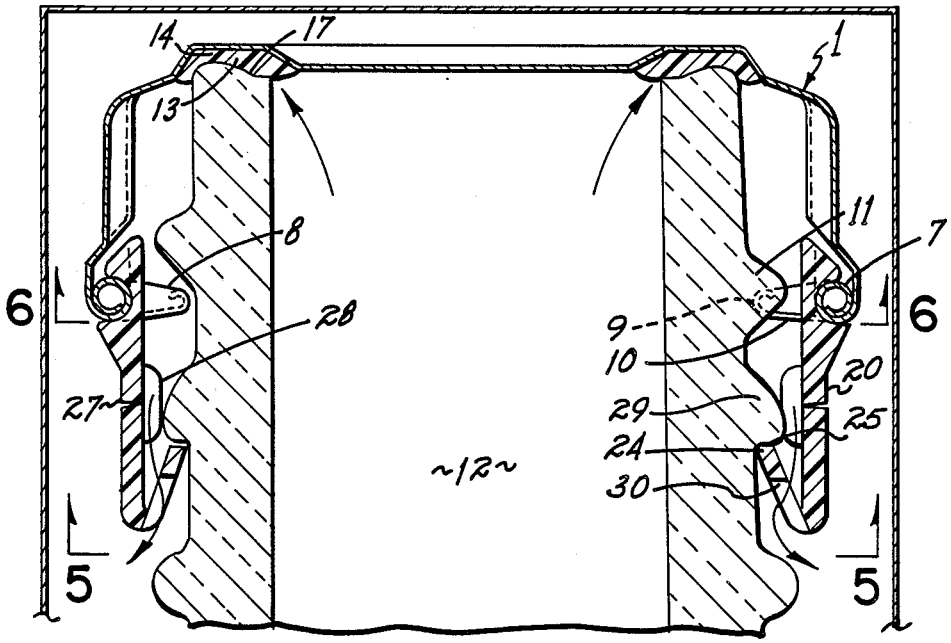
FIG. 4 is an enlarged sectional view of the sealed container taken along line 4—4 on FIG. 1.
Figure 6:
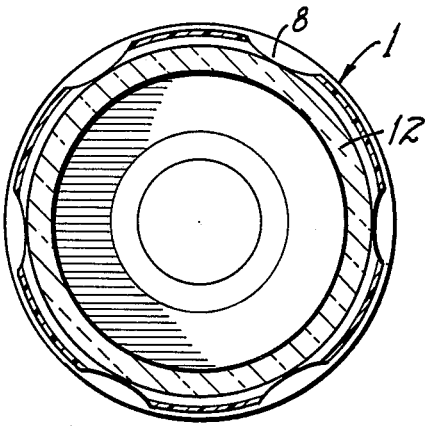
Figure 7:
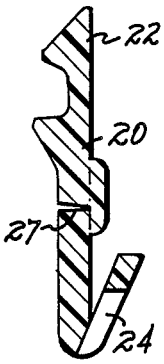
FIGS. 7 and 8 are vertical sectional views taken along lines 7-7 and 8-8 on FIG. 3.
Figure 8:
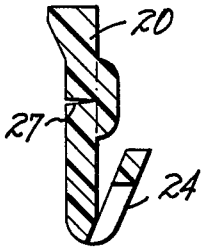

The lower edge of the cap skirt 3 has an inwardly rolled bead 7 connecting a series of spaced container thread engaging lugs 8. As best illustrated in FIG. 4 each of the lugs 8 includes an inner container thread engaging portion comprising a tight fold 9. The lug 8 is formed to include an upwardly and inwardly inclined lower portion 10 extending to the thread engaging fold 9 which is positioned about centrally of the depth of the skirt bead 7. The lugs 8 are formed as shown in FIG. 4 so that the fold 9 extends generally level or parallel to the lower edge of the skirt 3 and with the level fold 9 comprising a substantial portion of the circumferential length of each lug. As illustrated in FIG. 6, which is a sectional view of a lug 8, the lugs 8 are seen to extend radially inwardly for a substantial distance along a major portion of their circumferential length with the fold 9 having a slightly arcuate shape.

The lugs 8 of the closure cap 1 engage a series of inclined threads 11 on a container 12. A suitable gasket 13 is provided such as a plastisol ring positioned in a downwardly facing channel 14 in the cap cover 2. The application of the metal closure cap 1 to the container 12 with the lugs 8 tightly engaging the container lugs or threads 11 forces the sealing gasket 13 into sealing relationship with the container 12 rim 17. This seal is tightly maintained after the application of the closure 1 by the engagement of the metal lugs 8 with the container threads 11. This avoids the serious problem of creep found with composite plastic closures when heat is applied such as in pasteurizing the packaged product. The metal portion of closure 1 resists the deformation typical of plastic closures. The expansion of plastic closures during pasteurizing, for example, weakens the seal permitting the escape of liquid or gas from the sealed package. Thereafter, a higher vacuum results within the sealed package 26 when the closure cools and re-seals. The presence of such a vacuum, while useful with certain products, is injurious to other products such as pickle products which lose their crispness.

Figure 1:
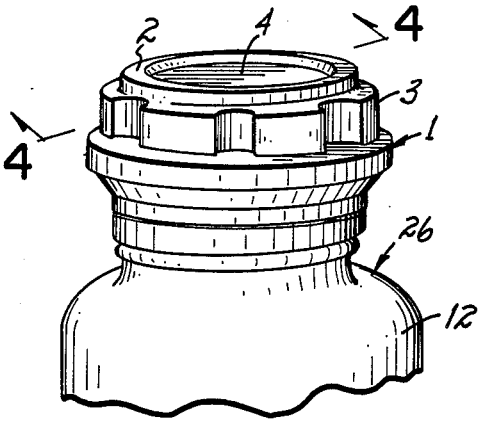
FIG. 1 is a perspective view of a preferred embodiment of a sealed container in accordance with the invention.
Figure 2:
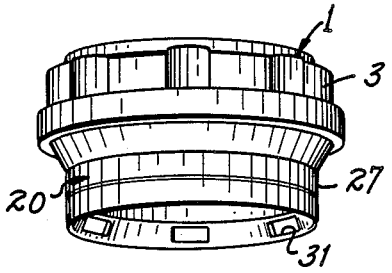
FIG. 2 is a perspective view of the closure of the invention.
Figure 3:
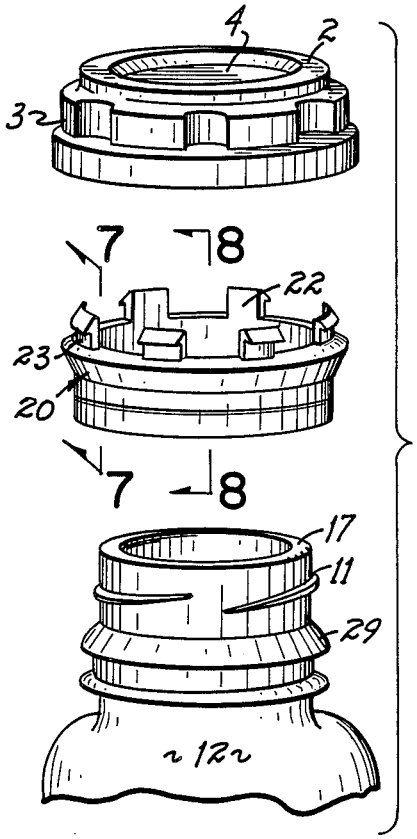
FIG. 3 is an exploded perspective view of the sealed package of FIG. 1.
Figure 10:
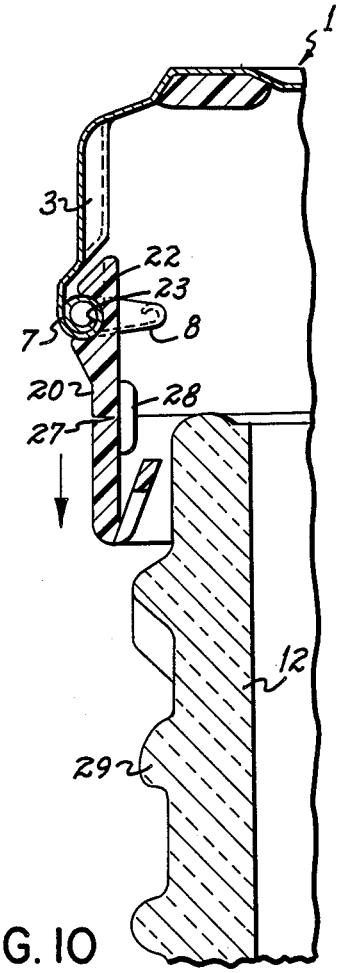
FIGS. 10 and 11 are enlarged vertical sectional views of the closure of the invention being applied to and removed from a container.
Figure 11:
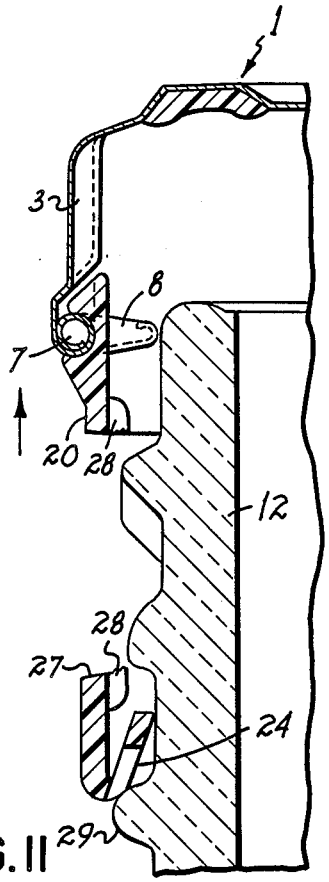

To provide for a tamper indication, a circular molded plastic insert band 20 is attached to the closure cap bead 7 on the closure cap skirt 3. This band 20 is molded from a suitable plastic with a generally ring shape and has a number of upwardly projecting hooks 22. A series of openings 21 between the hooks 22 allow the metal closure lug 8 to project past the hooks 22 to engage the container 1 lugs 11. The hooks 22, best illustrated in FIGS. 3 and 4, have an outwardly opening bead engaging slot 23 to permit them to be snapped into engagement with the rolled bead 7 at the lower edge of the closure cap skirt 3. The insert band 20 has an inwardly and upwardly directed locking flange or bar 24 formed on its lower edge. This bar 24, as illustrated in FIG. 4, has its inner and upper edge 25 engaged with or in close proximity to a circular bead 29 on the container 12 in the sealed package 26. When the package 26 is opened, as illustrated in FIG. 10, the lower and tamper indicating portion of the insert band 20 is torn free so that it drops downwardly onto the container 12 indicating either an unauthorized tampering with the package 26 or its normal opening. A line of weakness such as a circular cut 27 is formed in the plastic insert band 20 and a series of spaced bridges 28 maintain the insert band 20 in one piece until the package 26 is opened in the manner described above. In order to facilitate the application of the closure 1 without damage to the insert band 20 as the closure 1 is lowered onto and screwed onto the container 12 and to provide for draining of entrapped liquid, a series of slots 31 are formed in the locking flange 24.

Figure 12:
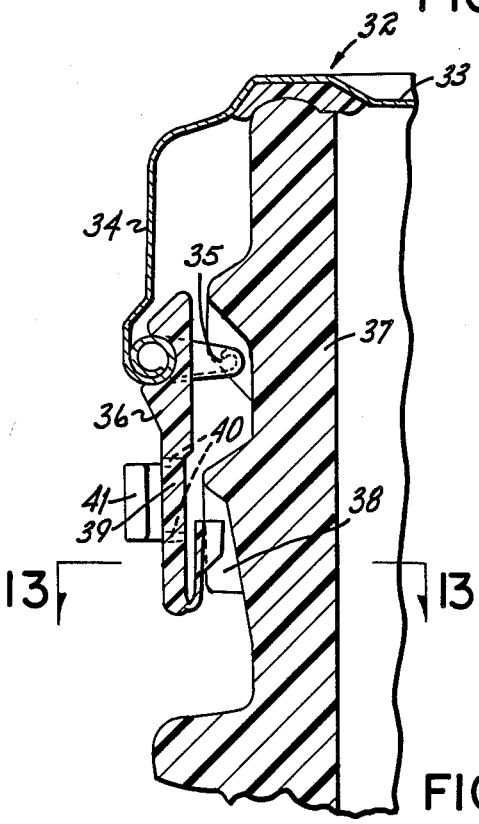
FIG. 12 is an enlarged vertical sectional view of the sealed container illustrating another embodiment of an insert band with a ratchet feature.
Figure 13:
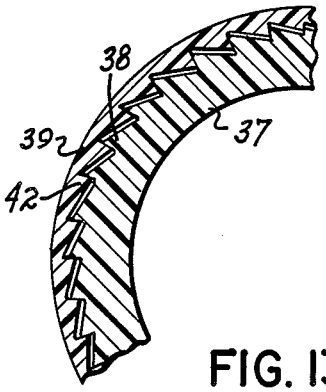
FIG. 13 is a horizontal sectional view taken along line 13—13 of FIG. 12.

FIGS. 12 and 13 illustrate an alternative embodiment which has a ratchet feature on its insert band. The closure cap 32 is similar to that of closure cap 1 described above, has the usual cover and has a similar cover 33 and skirt 34 with skirt 34 and lugs 35. The molded plastic insert band for this embodiment has a ratchet feature comprising inwardly forming tabs 42 for engaging ratchet teeth 38 molded on the container 37. In normal use a tab 41 is employed by the user to free the closure cap by removing a tear strip 39 defined by spaced lines of weakness 40.

If there is tampering with the closure and unauthorized attempt to remove the closure 32, the tabs 42 engage the ratchet teeth 38 on the container 37 and tear the portions of the insert band free giving a clear tamper indication.

It will be seen that an improved closure cap has been provided uniquely suited for packaging products where heating the product during packaging is involved. The cap has a lug structure wherein metal lugs are provided with the ability to accept internal pressure during elevated temperature processing. The capability of the package to accept internal pressure during processing makes the caps particularly suitable for use with pasteurized products; especially when no compensation outside pressure can be used.

Figure 3A:
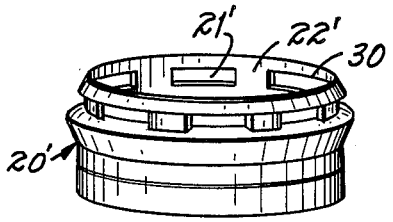
FIG. 3A is a perspective view of another embodiment of the plastic insert band.
Figure 9:
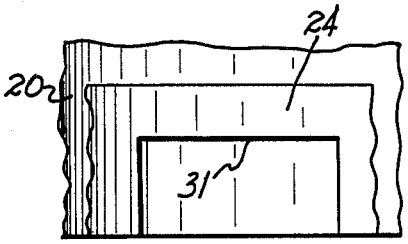
FIG. 9 is a fragmentary side elevational view of the plastic insert band looking radially outwardly of the circular band and showing a slot in the band.
Figure 5:
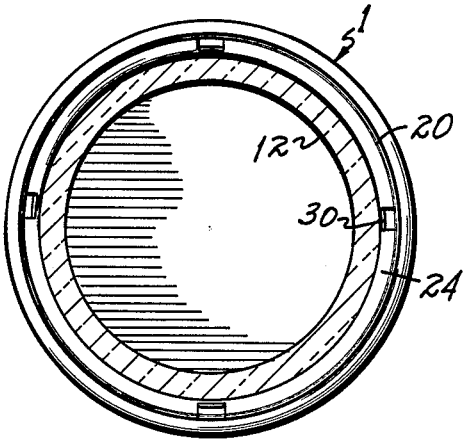
FIGS. 5 and 6 are horizontal sectional views taken along lines 5-5 and 6-6 respectively on FIG. 4.

FIG. 3A illustrates another embodiment of the plastic insert band at 20'. This insert band has the tops of the hooks 22' all connected by a circular band 30 connecting all of the hooks 22'. The openings 21' permit the cap lug 8 to engage the closure lugs 11.

As various changes may be made in the form, construction and arrangement of the parts herein without departing from the spirit and scope of the invention and without sacrificing any of its advantages, it is to be understood that all matter herein is to be interpreted as illustrative and not in a limiting sense.

Having thus described my invention, I claim:

1. In a clousre cap for sealing a container and having a metal shell with a cover and a depending skirt with a plurality of circumferentially spaced lugs projecting inwardly therefrom for engaging fastening means on a container the improvement which comprises a plastic insert band attached to and extending downwardly from said skirt having a tamper indicating portion defined by a line of weakness comprising container engaging locking means extending inwardly and upwardly from its lower edge.

2. The closure cap as claimed in claim 1 in which said insert band is molded plastic and has a plurality of closure shell engaging locking hooks on its top.

3. The closure cap as claimed in claim 2 in which an integral circular band connects the tops of said hooks.

4. The closure cap as claimed in claim 2 which further comprises apertures intermediate said hooks for accommodating said spaced lugs.

5. The closure as claimed in claim 1 in which said container engaging locking means comprises an inwardly and upwardly extending circular flange.

6. The closure as claimed in claim 5 which further comprises a plurality of spaced slots in said circular flange.

7. The closure as claimed in claim 1 in which said depending skirt has spaced grooves for facilitating gripping.

8. In a closure cap for sealing a container and having a metal shell with a cover and a depending skirt with an inwardly rolled bead at the lower edge of the skirt and a plurality of circumferentially spaced lugs projecting inwardly therefrom for engaging fastening means on a container the improvement which comprises a plastic insert band attached to and extending downwardly from said skirt having a lower tamper indicating portion defined by a line of weakness and comprising container engaging locking means extending inwardly and upwardly from the lower edge of said tamper indicating portion, and said plastic insert having means for accommodating said spaced lugs.

9. The closure cap as claimed in claim 8 in which said insert band is molded plastic and has a plurality of grooved and spaced bead engaging locking hooks on its top.

10. The closure as claimed in claim 8 in which said container engaging locking means comprises an inwardly and upwardly extending circular flange.

11. The closure as claimed in claim 10 which further comprises a plurality of spaced slots in said circular flange.

12. The closure as claimed in claim 8, in which said container engaging locking means comprises inwardly and upwardly extending ratchet tabs.

13. The closure as claimed in claim 8 in which said depending skirt has spaced grooves for facilitating gripping.

14. A sealed package comprising the combination of a container with closure engaging means and a tamper bead, a closure cap sealing the container and having a metal shell with a cover and a depending skirt with an inwardly rolled bead at the lower edge of the skirt and a plurality of circumferentially spaced lugs projecting inwardly therefrom engaging the container closure engaging means the improvement which comprises a plastic insert band attached to and extending downwardly from said skirt having a tamper indicating portion defined by a line of weakness, and container engaging locking means extending inwardly and upwardly from the lower edge of said tamper indicating portion for engaging said tamper bead.

15. The sealed package as claimed in claim 14 in which said insert band is molded plastic and has a plurality of bead engaging locking hooks on its top.

16. The sealed package as claimed in claim 14 in which said container engaging locking means comprises an inwardly and upwardly extending circular flange.

17. The sealed package as claimed in claim 16 which further comprises a plurality of spaced slots in said circular flange.

18. The sealed package as claimed in claim 14 in which said container engaging locking means comprises ratchet tabs engaging ratchet teeth on the tamper bead.

* * * * *